US007104435B2

(12) United States Patent
Holley, Jr.

(10) Patent No.: US 7,104,435 B2
(45) Date of Patent: Sep. 12, 2006

(54) CARTON WITH DISPENSER

(75) Inventor: John Holley, Jr., Lawrenceville, GA (US)

(73) Assignee: MeadWestvaco Packaging Systems LLC, Stamford, CT (US)

( * ) Notice: Subject to any disclaimer, the term of this patent is extended or adjusted under 35 U.S.C. 154(b) by 33 days.

(21) Appl. No.: 10/397,705

(22) Filed: Mar. 26, 2003

(65) Prior Publication Data

US 2004/0188509 A1 Sep. 30, 2004

(51) Int. Cl.
*A47F 1/04* (2006.01)

(52) U.S. Cl. ..... 229/221; 206/427

(58) Field of Classification Search ..... 229/221; 206/427; 221/305
See application file for complete search history.

(56) References Cited

U.S. PATENT DOCUMENTS

| | | | | |
|---|---|---|---|---|
| 2,968,431 | A * | 1/1961 | Pellaton | 229/230 |
| 3,178,242 | A * | 4/1965 | Ellis et al. | 312/45 |
| 3,228,582 | A * | 1/1966 | Osberg | 229/238 |
| 4,222,485 | A * | 9/1980 | Focke | 206/141 |
| 4,396,143 | A | 8/1983 | Killy | |
| 5,881,884 | A | 3/1999 | Podosek | |
| 6,283,293 | B1 * | 9/2001 | Lingamfelter | 206/427 |
| 6,386,369 | B1 | 5/2002 | Yuhas et al. | |
| 6,578,736 | B1 * | 6/2003 | Spivey | 221/305 |
| 2003/0234285 | A1 * | 12/2003 | Bates et al. | 229/244 |
| 2004/0099558 | A1 * | 5/2004 | Oliff et al. | 206/427 |

FOREIGN PATENT DOCUMENTS

| | | |
|---|---|---|
| DE | G 85 14 718.4 | 8/1985 |
| WO | 02/47990 A2 | 6/2002 |

* cited by examiner

*Primary Examiner*—Tri M. Mai
(74) *Attorney, Agent, or Firm*—Tsugihiko Suzuki, MWV; Parks Knowlton LLC; Cynthia R. Parks, Esq.

(57) ABSTRACT

A package comprises an article group formed of at least two vertically arranged tiers of cylindrical articles disposed on their sides in a side-by-side parallel fashion, and a carton disposed around the group. The carton comprises a top wall, opposed side walls, an end wall and an article dispenser. The side walls are disposed alongside the ends of the articles of the group while the end wall is disposed adjacent to the side walls of the adjacent endmost articles. The dispenser includes a corner portion of the carton formed from and detachably connected to the top, side and end walls to be removed from the carton to thereby define an opening for exposing at least some of the articles for removal. The opening is shaped to define a recess in each side wall to reveal at least a part of the endmost article in the lowermost tier of the article group.

10 Claims, 7 Drawing Sheets

CARTON WITH DISPENSER

BACKGROUND OF THE INVENTION

The invention relates to cartons, and more particularly, to a carton for multiple articles having a dispenser for constrained removal of individual articles. In particular the invention relates to a dispenser, which is adapted to improve access to the articles contained therein.

Cartons for encasing multiple articles are useful for enabling consumers to obtain and transport a desired quantity of individual articles such as soft drinks or other beverages. When such a multiple-pack of articles is obtained, a consumer frequently desires to remove one article from the carton at a time. Thus, it can be appreciated that it would be desirable to have a carton with a dispenser that facilitates the removal of a single article from the carton at a time.

When the articles contained in the carton are cylindrical, and are disposed in the carton upon their sides, it is important that the articles be constrained such that the remaining articles do not roll out of the dispenser when one is removed. It is also important that the dispenser provides a condition where the articles are easily accessed. Thus, it can be appreciated that it would be desirable to have a carton with a dispenser that constrains remaining articles so that they do not undesirably roll from or otherwise exit the carton when one article is removed. It can also be appreciated that it would be desirable to have a carton with a dispenser that facilitates access to the articles.

It is known to provide a carton having a dispenser for articles, which is provided when part of the carton is substantially detached or torn away from the upper corner of the carton to expose an endmost article for removal.

A problem associated with such known cartons is that a user can have difficulty in grabbing articles from within the dispenser. The present invention and its preferred embodiments seek to overcome or at least mitigate the problems of the prior art.

SUMMARY OF THE INVENTION

One aspect of the invention provides a carton comprising a top wall, a pair of opposed side walls connected to opposed side edges of the top wall, an end wall interconnecting the side walls, a bottom wall interconnecting respective lower edges of the side walls and an article-dispenser including a removable corner portion of the carton. The corner portion is defined by severance lines formed respectively in the top wall, the side walls and an end wall. The severance line in each side wall comprises a concave section for defining a recess in the respective side wall upon removal of the corner portion. In a preferred embodiment, the concave section of each side wall severance line is essentially U-shaped.

In an alternative embodiment, each side wall severance line may extend downwardly from the top wall to the lowest point along its concave section and may further extend upwardly from the lowest point to the end wall to be continuous with the end wall severance line. Preferably, each side wall severance line extends to the connection of the respective side wall with the end wall at a distance above the bottom wall generally equal to a half of the height of the carton. The lowest point of each side wall severance line may be spaced at a distance above the bottom wall less than a half of the height of the carton.

In another preferred embodiment, the end wall severance line extends continuously between the side walls so that an article stopper wall is formed from the end wall upon removal of the corner portion. Such a stopper wall extends continuously between the side walls. In this embodiment, the highest point along the upper edge of the stopper wall may be spaced at a first distance above the bottom wall while the lowest point along the concave section of each side wall severance line is spaced at a second distance above the bottom wall. The first distance is greater than the second distance.

A second aspect of the invention provides a package comprising an article group formed of at least two vertically arranged tiers of similarly dimensioned, cylindrical articles disposed on their sides in a side-by-side parallel fashion, and a carton disposed around the article group. The carton comprises a plurality of walls including a top wall, a pair of opposed side walls connected to the opposed side edges of the top wall, an end wall interconnecting the side walls, a bottom wall interconnecting the respective lower edges of the side walls and an article dispenser for dispensing the articles from the carton. The dispenser includes a removable corner portion of the carton formed from the top, side and end walls. The corner portion is detachably connected to the top, side and end walls along a detachable connection to be removed from the carton thereby to define an opening for exposing at least some of the articles for removal. The opening is shaped to define a recess in each side wall to reveal at least a part of the endmost article in the lowermost tier of the article group.

In one class of embodiments, the detachable connection comprises severance lines for defining the edge of the opening. The severance lines are formed respectively in the top wall, the side walls and the end wall, and the severance line in each side wall comprises a concave section for defining the recess in the respective side wall.

Optionally, the concave section of each side wall severance line may be essentially U-shaped. Alternatively, each side wall severance line may extend downwardly from the top wall to the lowest point along its concave section and may further extend upwardly from the lowest point to the end wall to be continuous with the end wall severance line. Each side wall severance line may extend to the connection of the respective side wall with the end wall at a distance above the bottom wall generally equal to three halves of the diameter of each articles while the lowest point of each side wall severance line may be spaced at a distance above the bottom wall less than the diameter of each article. Preferably, the article group is formed of three vertically arranged tiers of the articles, and the side wall severance lines are disposed respectively across the opposite ends of the endmost article in the lowermost tier.

In another class of embodiment, the end wall severance line extends continuously between the side walls so that the article stopper wall is formed from the end wall upon removal of said corner portion. The highest point along the upper edge of the stopper wall may be spaced at a first distance above the bottom wall whereas the lowest point along the concave section of each side wall severance lines may be spaced at a second distance above the bottom wall. The first distance may be greater than the diameter of each article while the second distance may be less than the diameter of each article.

A third aspect of the invention provides a blank for forming the carton as described above.

BRIEF DESCRIPTION OF THE DRAWINGS

Exemplary embodiments of the invention will now be described, by way of example only, with reference to the accompanying drawings in which.

DETAILED DESCRIPTION OF THE PREFERRED EMBODIMENTS

Referring to FIGS. 1–7, there is shown a carton having a dispenser for dispensing the or each article contained within the carton and a blank for forming a carton. The blank and carton are formed from paperboard or other foldable sheet material, for example plastics material or the like, to which there has been added cut and fold lines. The cartons are used to hold articles, for example cans or bottles, and to dispense the articles. In the illustrated embodiment a unitary blank is used to make a single carton, although it is envisaged that two or more blanks may be employed for example, to provide the dispenser structure, described in more detail below.

Figure 1:
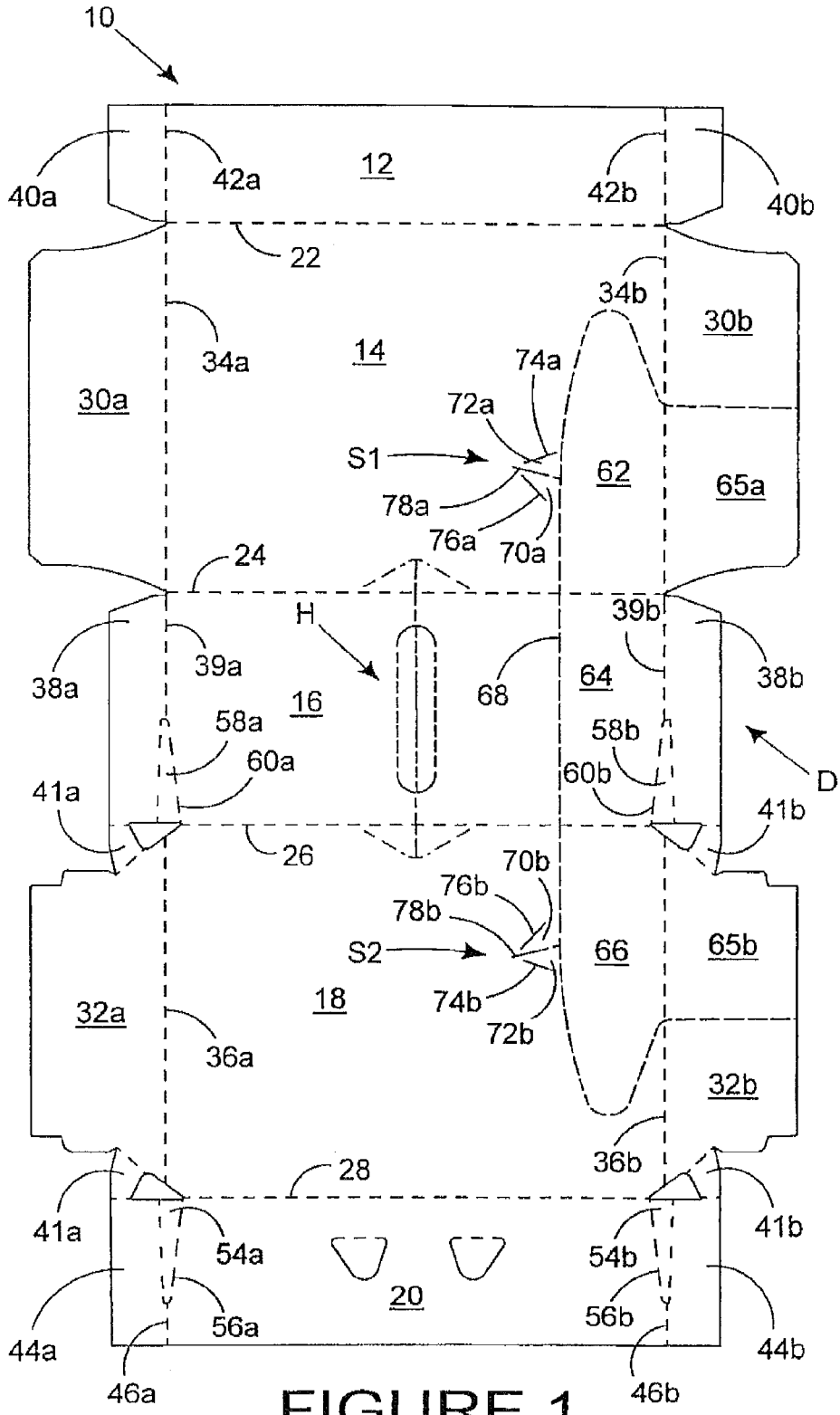
FIG. 1 illustrates a plan view of a blank for forming a carton with a dispenser according to a first embodiment of the invention.

Referring first to FIG. 1, there is shown a blank 10 for forming a carton with a dispenser. The blank 10 comprises a first base wall panel 12, a first side wall panel 14, a top wall panel 16, a second side wall panel 18 and a second base wall panel 20 hingedly connected one to the next in series along fold lines 22, 24, 26 and 28 respectively.

Along each longitudinal edge of the blank 10, there comprises a series of end wall panels and flaps for forming the respective end wall of the carton. Each end wall is identical and therefore like references has been used, with the affix "a" or "b". Therefore, only the rear end will now be described in any greater detail.

The rear end wall comprises a first end wall panel 30*a* hingedly connected to the first side wall panel 14 along a fold line 34*a* and a second end wall panel 32*a* hingedly connected to the second side wall panel 18 along a fold line 36*a*. There further comprises support flaps 40*a*, 38*a* and 44*a* hingedly connected to the first base wall panel 12, the top wall panel 16 and the second base wall panel 20 along fold lines 42*a*, 39*a* and 46*a* respectively.

In this embodiment, the support flaps 38*a*, 44*a* are hingedly connected to the end wall panel 32*a* by web panels 41*a*, 41*a* to improve the folding action of and construction of the respective end wall, described in more detail later.

In this embodiment, there further comprises triangular beveled panels between the top and end walls and/or the bottom and end walls such that in FIG. 1, there comprises a triangular beveled panel 54*a* hingedly connected to the second base wall panel 20 and the end support flap 44*a* along fold lines 56*a* and 46*a*. Preferably, there further comprises a second triangular beveled panel 58*a* hingedly interconnecting the top wall panel 16 with the support flap 38*a* along fold lines 60*a* and 39*a*.

In FIG. 1, the opposed front end comprises a beveled panels 54*b* and 58*b* defined between the base wall panel 20 and the front end wall and the top wall panel 16 and the front end wall respectively.

Figure 7:
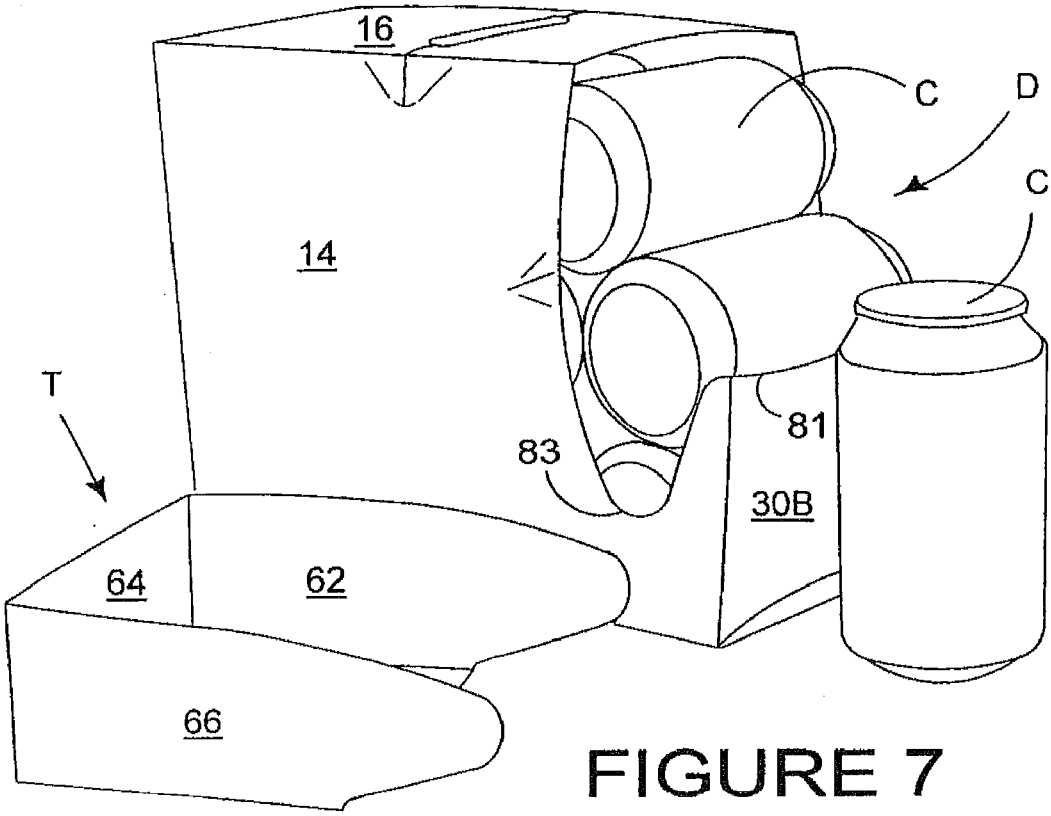
FIG. 7 is a perspective view illustrating the carton with the corner portion removed to reveal the dispenser opening.

A dispenser D is formed at the front end of the blank which, in this embodiment, is provided by a removable corner portion T (FIG. 2) comprising a plurality of panels 65*a*, 62, 64, 66 and 65*b*. The corner portion T detached from the carton is shown in FIG. 7.

Figure 4:
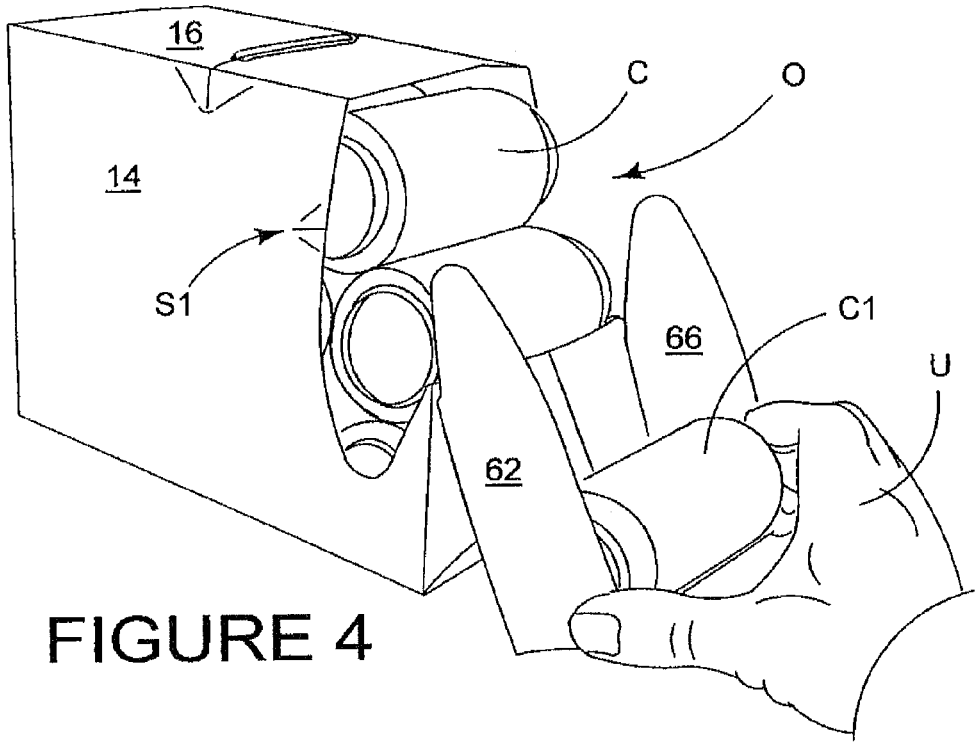

Turning to FIG. 1 to further explain the construction of the removable portion T, the panel 65*a* is formed from the end wall panel 30*b*, panels 62, 64, 66 is formed from the first side wall panel 14, the top wall panel 16, and the second side wall panel 18, respectively, and the panel 65*b* is formed from the end wall panel 32*b*. The panels 65*a*, 62, 64, 66 and 65*b* are frangibly connected to the respective panels by a detachable connection 68 that comprises a series of severance lines shaped to define a dispenser opening O (FIG. 4). The severance lines are formed in the panels 30*b*, 14, 16, 18 and 32*b* respectively.

In this embodiment, there comprises one or more tear or severance initiation means in the form of finger punch-through arrangements S1, S2 for grasping the removable portion T. Preferably one finger punch-through arrangement is struck from each side wall panel so that the removable portion T is detached or severed from the carton by using a cross-tearing motion.

Figure 3:
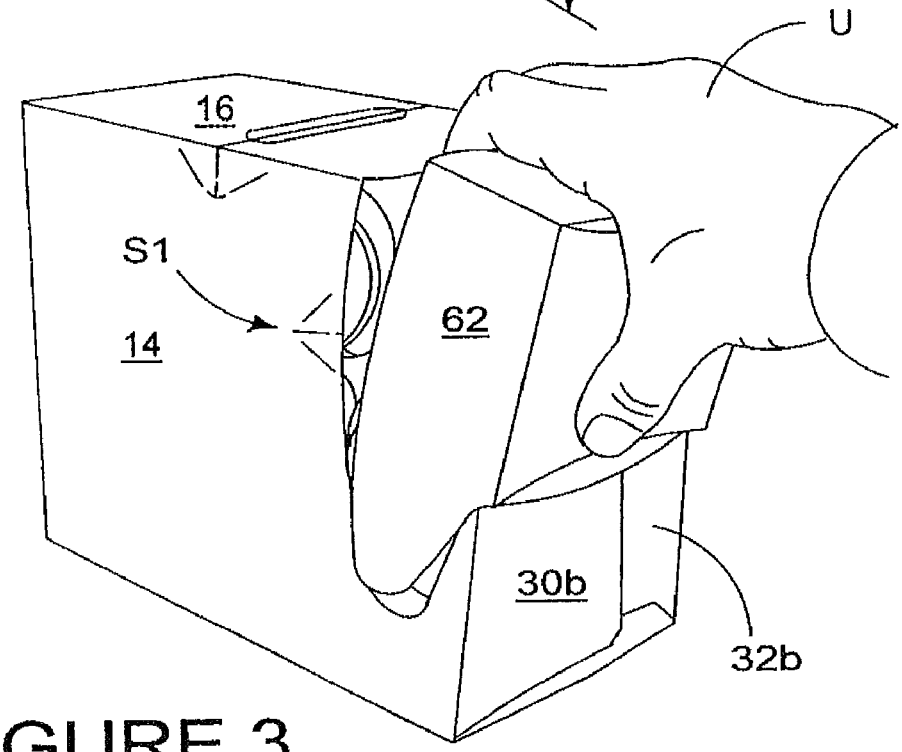
FIGS. 3 and 4 are perspective views illustrating the removal of a corner portion to form a dispenser opening of the carton shown in FIG. 2.

Each finger punch-through arrangement S1, S2 is substantially the same, and therefore only the arrangement S1 will be described below. The punch-through arrangement S1 comprises a first panel 70*a* and a second panel 72*a* hingedly connected to the first side wall panel 14 along fold lines 76*a*, 74*a* respectively. Each panel 70*a*, 72*a* is separated by a cut line 78*a* so that in use the panel 70*a* and 72*a* are pushed inwardly to allow the user to grasp the removable portion. Alternatively, the removable portion T may be grasped together with the article positioned within the removable portion as shown in FIGS. 3 and 4.

It will be seen from FIG. 1 that the blank further comprises a suitable known handle H to allow the user to carry the carton.

In order to form a completed carton in flat collapsed condition from the blank, a series of sequential folding and gluing operations are required and will be described further with reference to FIGS. 1 and 2 of the drawings. The folding and gluing operations can be performed in one or more straight-line machines so that the blank or carton is not required to be rotated or inverted to complete its construction. The folding process is not limited to that described below and can be altered according to particular manufacturing requirements.

Figure 2:
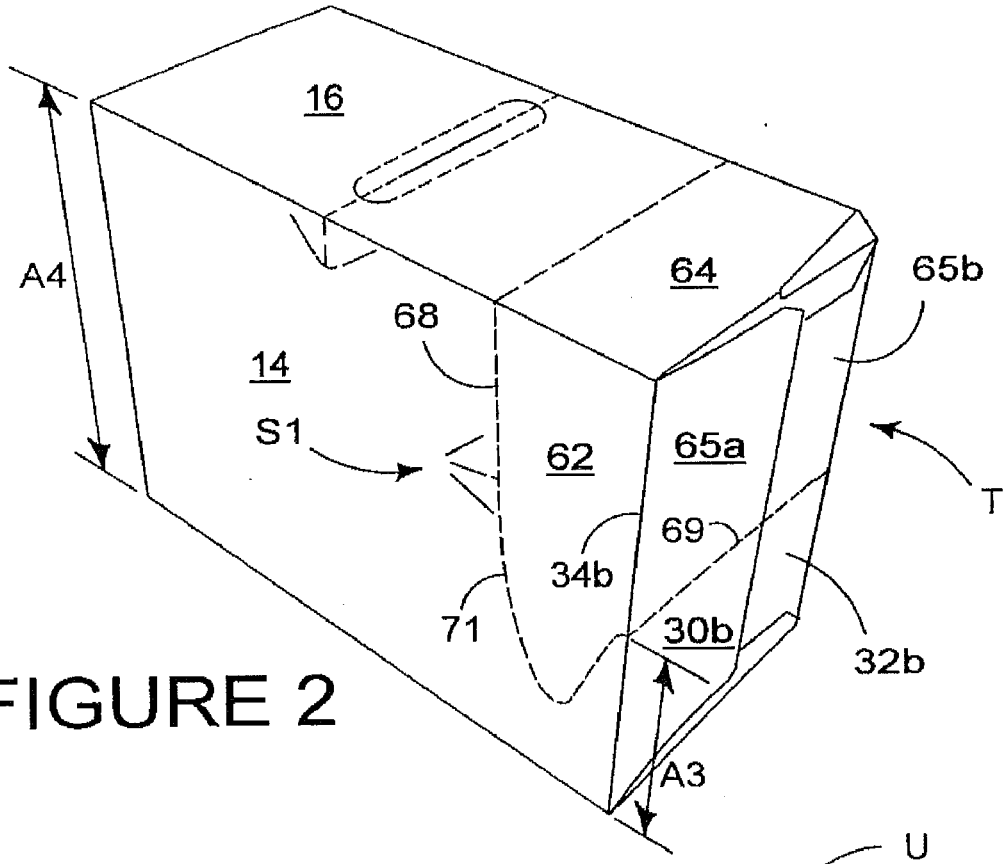
FIG. 2 is a perspective view illustrating a carton formed from the blank shown in FIG. 1.

In order to construct an erected carton shown in FIG. 2 from the blank of FIG. 1, the first side wall panel 14 is folded inwardly along fold line 24 to lie flat on top of the panels 16 and 18. Glue is applied to first base wall panel 12 and the support flaps 40*a*, 40*b*, and then second base wall panel 20 is folded inwardly along the fold line 28 to lie flat on the first base wall panel 12. By this means, the first and second base wall panels 12, 20 are glued together to form a composite bottom wall 12/20, the support flaps 40*a*, 44*a* are glued together to form a composite rear end bottom flap 40*a*/44*a* and the support flaps 40*b*, 44*b* are glued together to form a composite front end bottom flap 40*b*/44*b*. This provides a flat tubular carton.

The flat tubular carton is expanded into an open ended tubular form. Articles, for example cans C, are loaded through one or both of the open ends of the carton, and the end walls are formed to close the ends of the carton. As each end wall is substantially the same, the rear end wall will hereinafter be described.

First, the end wall panel 32*a* is folded outwardly along the fold line 36*a* to cause the web panels 41*a* and 41*a* to be folded inwardly and to thereby cause the support flap 38*a* and the rear end bottom flap 40*a*/44*a* to be automatically folded inwardly along the fold lines 39*a*, 60*a*; and 42*a*/46*a*, 56*a*. The end wall panels 32*a* and 30*a* are then folded inwardly and secured together by glue or other suitable securing means. Preferably, the support flap 38*a* and the rear end bottom flap 40*a*/44*a* are also secured to the inside surface of the end wall panels 30*a* and 32*a* to provide additional support to the end walls. The front end wall is formed in the same manner. After the articles are loaded into the carton, the carton is supplied to an end user in the form shown in FIG. 2.

Thus, the carton is in a completed and closed condition, shown in FIG. 2. The carton is adapted to hold a group of similarly dimensioned, cylindrical articles (such as cans or bottles), in two or more, and preferably three (shown in FIGS. 4 and 5), vertically arranged tiers. The articles in each tier are disposed on their sides in a side-by-side parallel fashion. The side wall panels 14, 18 are disposed alongside the ends of the articles of the group while each end wall of the carton is disposed adjacent to the side walls of the respective endmost articles.

The removable corner portion T is integrally formed as an upper-front end portion of the carton to be displaceable to form the dispenser D.

Figure 5:
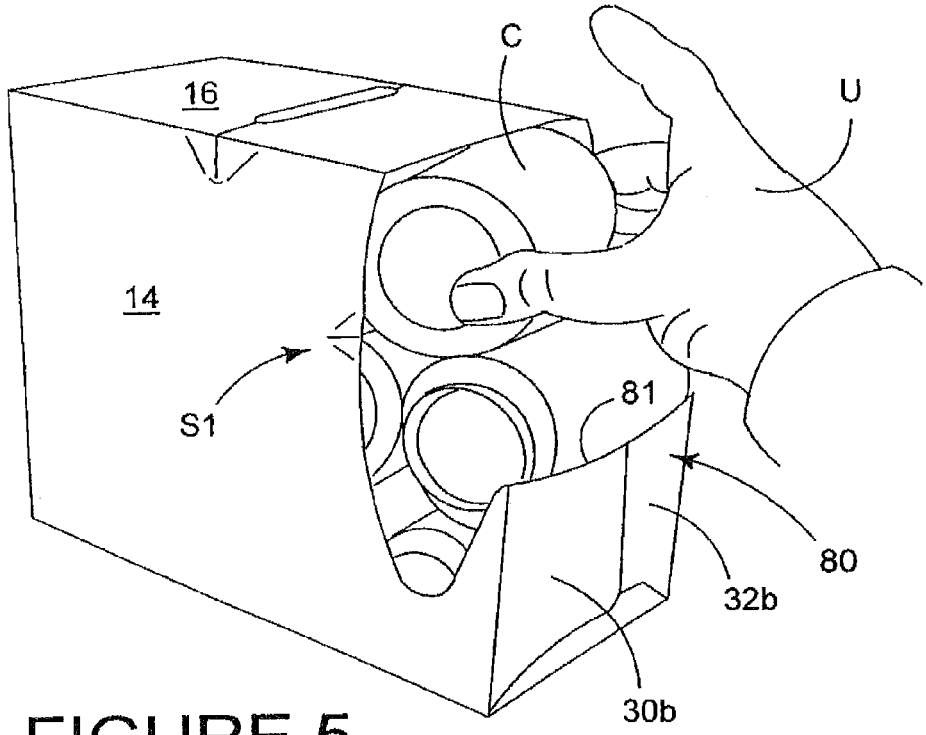
FIGS. 5 and 6 are perspective views illustrating the removal of articles from of the carton shown in FIG. 4.

To open the carton of FIG. 2, a user grabs the removable corner portion T, by pushing his finger or fingers through either finger punch-through arrangement S1 or S2 to engage the cusp of the corner portion T on the respective side wall panel and severs the corner portion T from the carton along the detachable connection 68 using a cross tearing motion. Alternatively, the corner portion T may be grasped from the top by breaking the top wall severance line as shown in FIG. 3 and then it may further be severed along the detachable connection 68 using a downward tearing motion. In either opening process, the endmost article in the topmost tier may be grasped together with the corner portion T to prevent the endmost article from being expelled from the carton and/or to use the endmost article as a tool for facilitating breaking of the detachable connection 68. By removing or detaching the corner portion T, the end portion of the carton is exposed to provide a dispenser opening O (FIG. 4) for the articles so that the user can gain access to the articles "C" in the uppermost tier as shown in FIG. 5. One advantage of having the punch-through arrangements S1, S2 provided on the opposite side wall panels is that either right-handed or left-handed person can easily open the carton.

Figure 6:
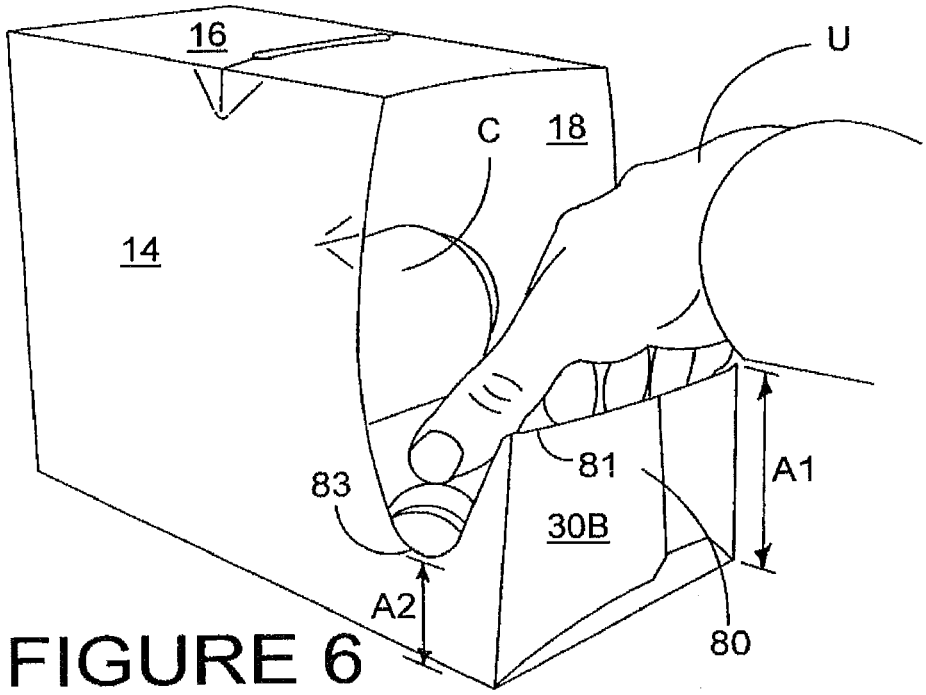

When the corner portion T is detached, the lower portion of the front end wall forms a stopper wall 80, shown in FIGS. 5 and 6 that extends upwardly from the bottom wall 12/20 between the side wall panels 14 and 18. The upper edge 81 of the stopper wall 80 is defined by the end wall severance line 69 (FIG. 2) of the detachable connection 68 so that the stopper wall 80 by itself is capable of inhibiting the articles "C" in the lowermost and middle tiers from inadvertently exiting the carton before intended removal and the contents of the carton are easily viewed through the dispenser opening O. The highest point along the upper edge 81 is spaced at a first distance A1 (FIG. 6) above the bottom wall 12/20. The first distance A1 is greater than the diameter of each article "C" and preferably around three halves of the diameter of each article.

Each side edge of the dispenser opening O is defined by the respective side wall severance line 71 (FIG. 2) of the detachable connection 68. As best shown in FIG. 2, the side wall severance line 71 extends downwardly from the top wall panel 16 to the lowest point along the severance line 71 and then extends upwardly from the lowermost point to the hinged connection 34*b* of the side wall panel 14 with the end wall panel 30*b*. The other side wall severance line in the side wall panel 18 extends in the same manner.

More particularly, the lower section of each side wall severance line 71 is shaped concave or U-shaped. This concave section defines a recess 83 in the respective side wall (FIGS. 6 and 7) upon removal of the corner portion T. The concave section of each side wall severance line 71 extends across the adjacent end of the endmost article in the lowermost tier to partially expose the opposite ends of the endmost article as shown in FIGS. 5–7. The lowest point along the concave section of each side wall severance line 71 is spaced at a second distance A2 (FIG. 6) above the bottom wall 12/20. The second distance A2 is less than the diameter of each article "C", and preferably around a half of the diameter of each article, so that a user U can easily grasp the articles in the middle and lowermost tiers as best shown in FIG. 6. The curvature of the concave sections of the side wall severance lines 71 also helps to increase the exposed areas of the article ends to allow the article to be grasped by its opposite ends. The intersection of the severance line 71 in the side wall panel 14 and the hinged connection 34*b* is spaced at a third distance A3 (FIG. 2) above the bottom wall 12/20. The third distance A3 is greater than the diameter of each article "C", and preferably around three halves of the diameter of each article or a half of the height A4 of the carton, so that the stopper wall 80 maintains adequate structural rigidity to retain the articles in the middle and lowermost tiers. After the endmost article (the can C1 in the removable corner portion T in FIG. 4) is removed from the uppermost tier, the remaining articles "C" in the uppermost tier will nest in the spaces between the articles in the middle tier. Nesting of articles in this manner is well known in the art and is not illustrated.

The position of the finger punch through means is preferably in registry with the space at the center of four end cans at the front end of the carton, i.e., the two endmost cans in the uppermost and middle tiers and the two adjacent cans in the same tiers. This arrangement not only facilitates detachment of the removable corner portion T but also assists in preventing an article from being expelled from, or jumping out of, the carton. The reason why it could be a "jumping article" preventor is that a consumer could hold the endmost article in the uppermost tier by inserting his index or middle finger through the punch through arrangement and could use the endmost can as a tool for breaking the detachable connection 68. In this case, the endmost article is held by the consumer whilst the removable corner portion T is detached and therefore the can is not ejected or expelled from the carton.

A second embodiment of the invention is shown in FIGS. 8 to 12 which disclose a carton for accommodating a group of similarly dimensioned, cylindrical articles (such as cans or bottles) in two vertically arranged tiers.

Figure 8:
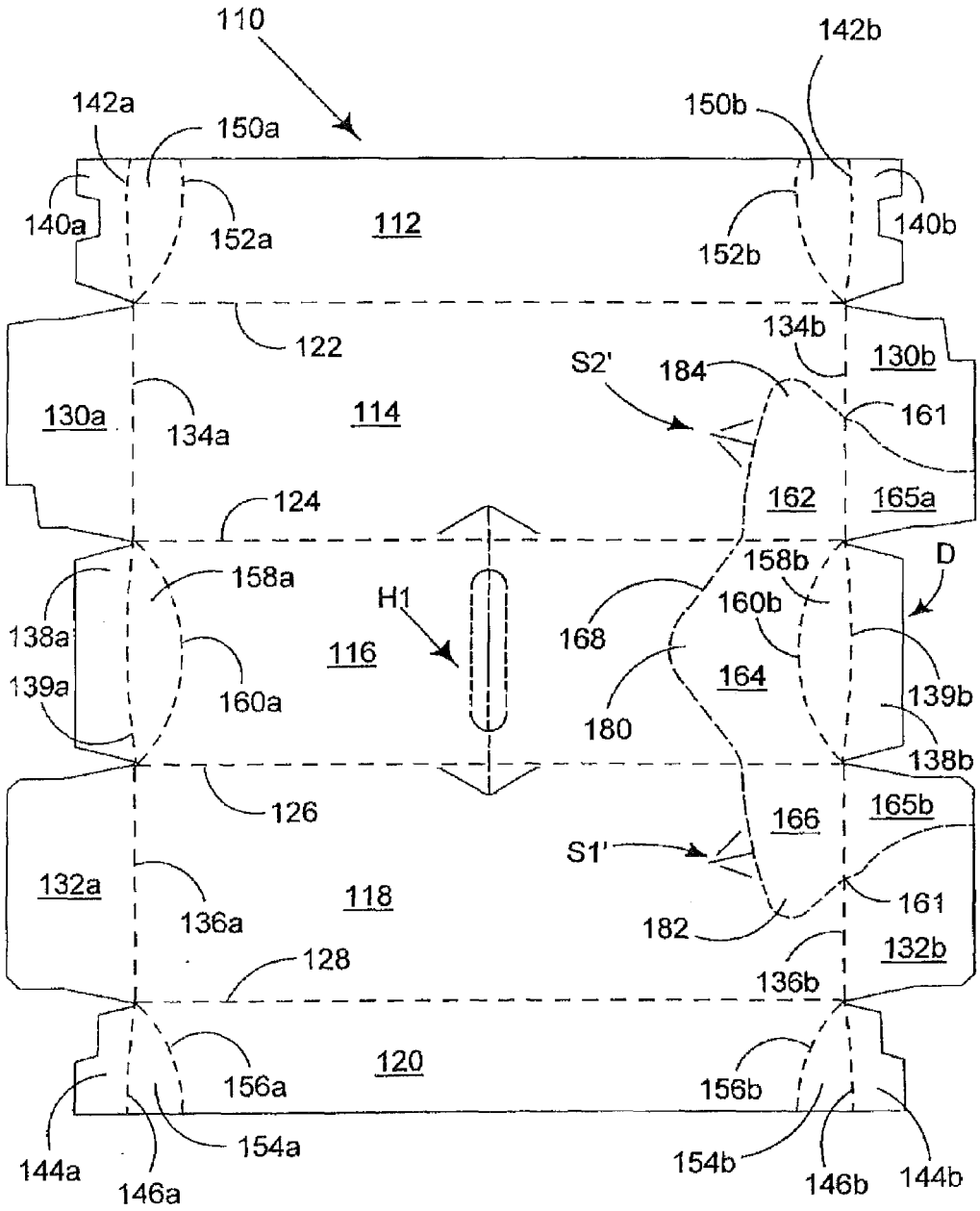
FIG. 8 illustrates a plan view of a blank for forming a carton with a dispenser according to a second embodiment of the invention.

FIG. 8 shows a blank 110 for forming a carton with a dispenser, formed from paperboard or like foldable sheet material. The blank is similar to the first embodiment and like references have been used with the prefix "1". The blank 110 comprises a first base wall panel 112, a first side wall panel 114, a top wall panel 116, a second side wall panel 118 and a second base wall panel 120 hingedly connected one to the next in series along fold lines 122, 124, 126 and 128 respectively.

Along each longitudinal edge of the blank 110, there comprises a series of end wall panels and flaps for forming an end wall of the carton. Each end wall is identical and therefore like references has been used, with the affix "a" or "b". Therefore, only the rear end will now be described in any greater detail.

The rear end wall comprises first end wall panel 130*a* hingedly connected to first side wall panel 114 along fold line 134*a* and a second end wall panel 132*a* hingedly connected to the second side wall panel 118 along fold line 136*a*. There further comprises support flaps 140*a*, 138*a* and 144*a* hingedly connected to first base wall panel 112, top wall panel 116 and second base wall panel 120 along fold lines 142*a*, 139*a* and 146*a* respectively. In use, the support flaps 140*a*, 138*a* and 144*a* are engaged with and support the respective end wall panels 130*a* and 132*a*.

Beveled panels are provided between the top wall panel and end walls and/or the base wall panel and end walls such that in this embodiment there comprises a first part 150*a* of a first beveled panel positioned intermediate end support flap 140*a* and base wall panel 112 and hingedly connected thereto along fold lines 142*a* and 152*a*. A second part of the first beveled panel is provided by panel 154*a* hingedly connected to second base wall panel 120 and end support flap 144*a* along fold lines 146*a* and 156*a*. Preferably, there further comprises a second beveled panel 158*a* hingedly interconnecting top wall panel 116 and end support flap 138*a* along fold lines 139*a* and 160*a*.

In FIG. 8, the front end comprises a beveled panel 158*b* defined between the top wall panel 116 and the respective end wall panel 138*b*, and another beveled panel 150*b*/154*b* between the bottom wall 112/120 and the end wall.

A dispenser D is formed at the front end of the blank which is provided by a plurality of panels formed from the end wall panels 130*b*, 132*b*, the opposed side wall panels 114, 118 and the top wall panel 116. In use, a corner portion L is removed from the side, end and opposite side wall panels to form the dispenser D or opening O shown in FIG. 11.

Returning to FIG. 8 to explain the detailed construction of the corner portion L, there comprises a series of panels, i.e., panel 165*a* formed from the respective end wall panel 130*b*, panels 162, 164, 166 formed from the side wall panel 114, the top wall panel 116, and the second side wall panel 118 respectively and panel 165*b* formed from end wall panel 132*b*. The panels forming the corner portion L are frangibly connected to the respective side, top and end wall panels by a detachable connection 168 including a series of severance lines that are formed in the panels 130*b*, 114, 116, 118 and 132*b* respectively. These frangible lines 168 are shaped to define an opening O that is different in shape from the first embodiment. More specifically, the top wall severance line is essentially V-shaped. This results in the dispenser opening O that improves the view of the uppermost tier articles. This V-shaped severance line of the detachable connection 168 is also advantageous because it is arranged so as to overlie the second endmost article in the uppermost tier, not to overlie the space between the endmost and the adjacent inner articles in the uppermost tier. This arrangement prevents or at least mitigates undesired breakage or rupture of the top wall severance line during transportation, storage and/or handling of the carton.

The severance line in the end wall panels 130*b*, 132*b* (FIG. 9) is curved to reach an elevation higher than the diameter of an article C. The severance line formed in each side wall panel 114, 118 is curved to define a recess in the respective side wall panel upon removal of the corner portion L. The benefit of these curved severance lines are described later in more detail.

The carton of this embodiment is provided also with one or more finger punch-through arrangements, S1', S2' for grasping the corner portion L. Preferably a finger punch-through arrangement is struck from each side wall panel 114, 118 so that the corner portion L is detached from the carton by using a cross-tearing motion. Each finger punch-through arrangement S1', S2' is substantially the same as those shown in FIG. 1 described above and are therefore not described in any further detail.

It will be seen from FIG. 8 that the blank further comprises a suitable known handle H1 to allow the user to carry the carton.

To erect the above described blank, a carton-forming process similar to the first embodiment may be used. As a result of the panel-gluing process, the first and second base wall panels 112, 120 are glued together to form a composite bottom wall, the support flaps 140*a*, 144*a* are glued together to form a composite rear end bottom flap and the support flaps 140*b*, 144*b* are glued together to form a composite front end bottom flap. The detail of the carton-forming process is not further described.

Figure 9:
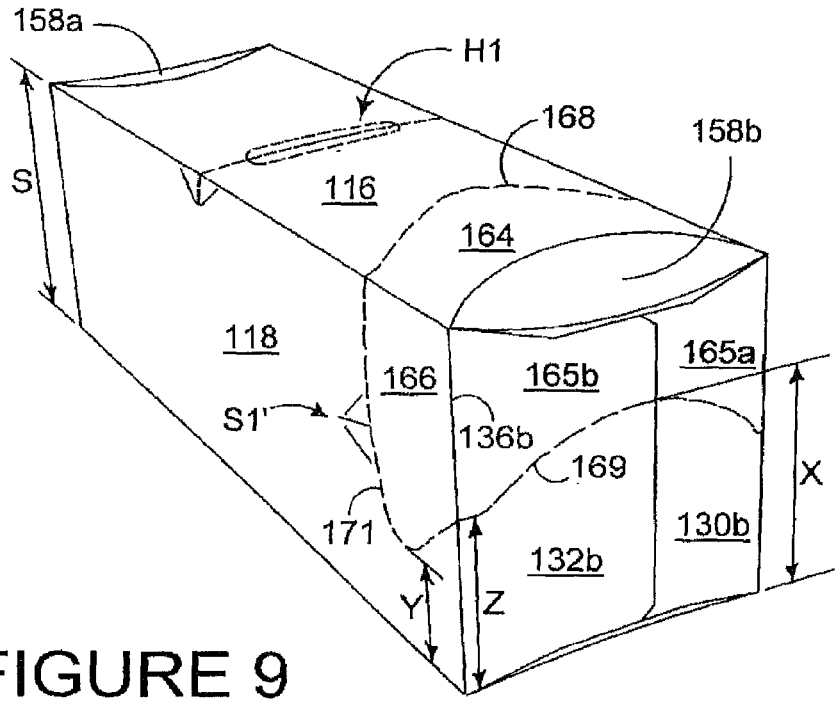
FIG. 9 is a perspective view illustrating a carton formed from the blank shown in FIG. 8.
Figure 10:
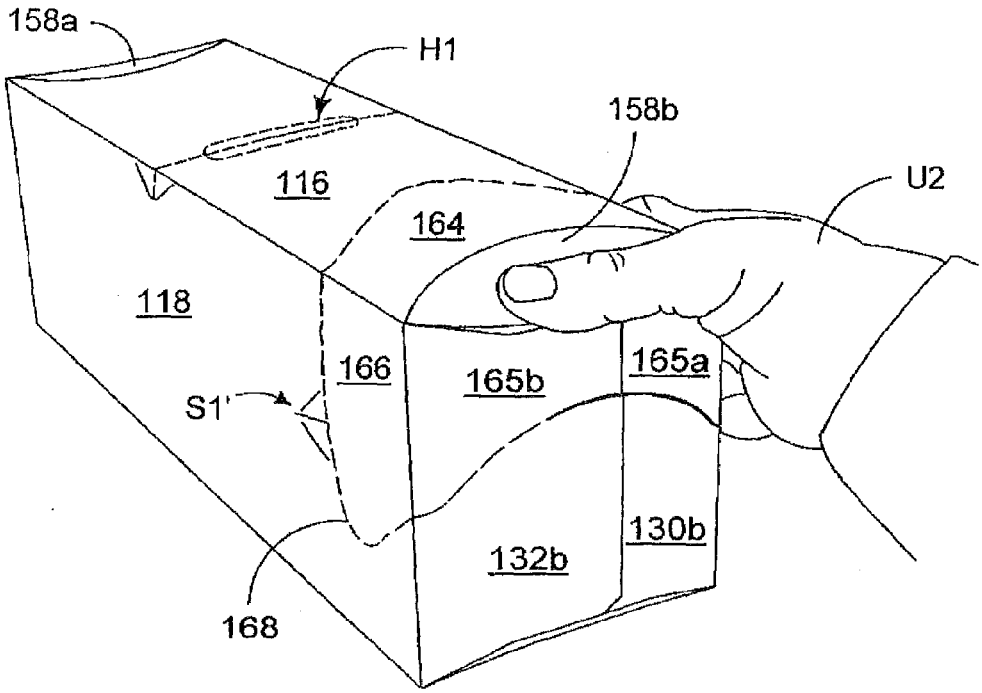
FIG. 10 is a perspective view illustrating the removal of a corner portion to form a dispenser opening of the carton shown in FIG. 9.

The severance line in the front end wall (the end wall panels 130*b*, 132*b*) is curved or arched as shown in FIG. 9 to reach an elevation higher than the diameter of an article C. The highest point along the end wall severance line 169 within the end wall panels 130*b*, 132*b* is located at a first distance X (FIG. 9) greater than a half of the height S of the carton. In this embodiment, the first distance X is around three halves of the diameter of each article.

Figure 11:
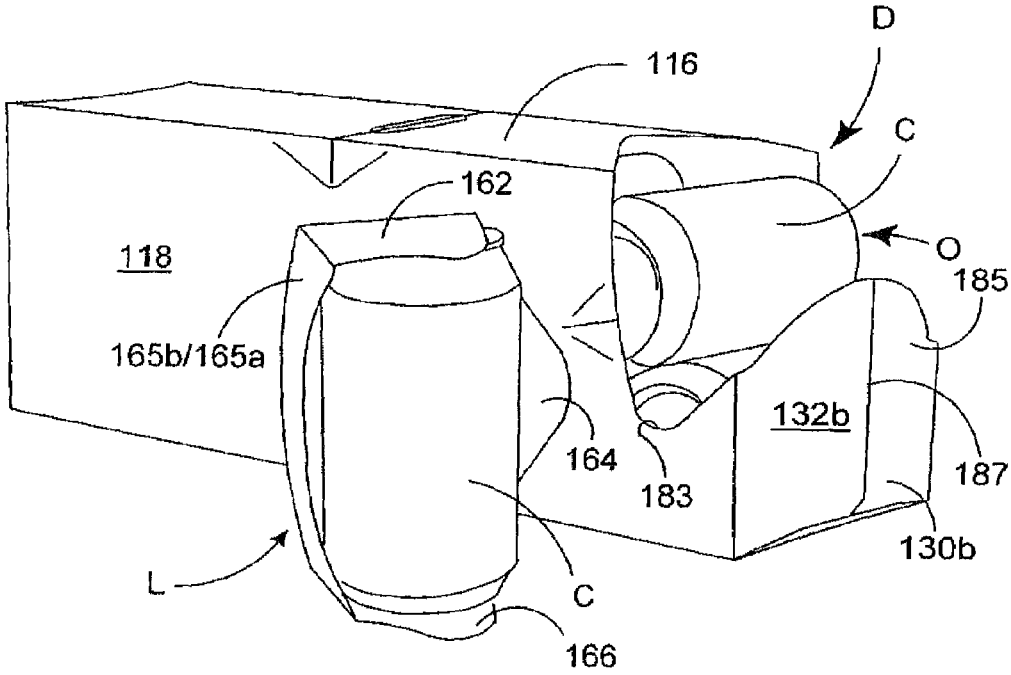
FIG. 11 is a perspective view illustrating the carton with the corner portion and an endmost article removed to reveal the dispenser opening in the carton of FIG. 9.
Figure 12:
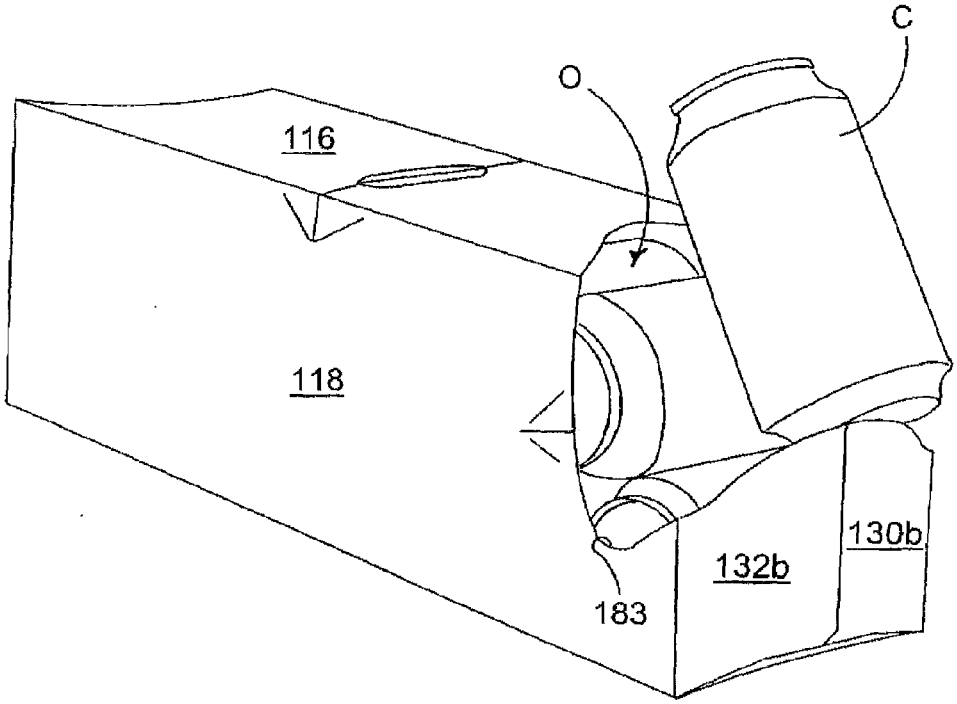
FIG. 12 is a perspective view illustrating the carton with an endmost article placed back into the carton after it is once removed from the carton of FIG. 11.

Each side edge of the dispenser opening O (FIG. 11) is defined by the respective side wall severance line 171. As in the first embodiment, the side wall severance line 171 also extends downwardly from the top wall panel 116 to the lowest point along the severance line 171 and then extends upwardly from the lowermost point to the hinged connection 136*b* of the side wall panel 118 with the end wall panel 132*b*. The other side wall severance line in the side wall panel 114 curved in the same fashion. The lower section of each side wall severance line 171 is shaped concave or U-shaped. The concave section defines a recess 183 (FIGS. 11 and 12) in the respective side wall upon removal of the corner portion L. The concave section of each side wall severance line 171 extends across the adjacent end of the endmost article in the lower tier to partially expose the opposite ends of the endmost article as shown in FIGS. 11 and 12. The lowest point along the concave section of each side wall severance line 171 is spaced at a second distance Y (FIG. 9) above the bottom wall 112/120. The second distance Y is less than the diameter of each article "C", and preferably around a half of the diameter of each article, so that a user can easily grasp the articles in the upper and lower tiers. The intersection of the severance line 171 in the side wall panel 118 and the hinged connection 136*b* is spaced at a third distance Z (FIG. 9) above the bottom wall 112/120. The third distance Z is greater than, or generally equal to, the diameter of each article "C" or a half of the height S of the carton, so that the stopper wall 185 maintains adequate structural rigidity to retain the articles in the upper and lower tiers. After the endmost article (the can C in the removable corner portion L in FIG. 11) is removed from the upper tier, the remaining articles "C" in the upper tier will nest in the spaces between the articles in the lower tier.

The front stopper wall 185 with the arched upper edge is also of utility when a user desires to place the endmost article C back into the carton after it is once removed from the carton. The endmost article C (such as a can) may be placed with its side down in the space between the second endmost article in the upper tier and the stopper wall 185. Alternatively, the endmost article C may be placed with its bottom down on top of the stopper wall 185 while resting against the adjacent or second endmost article as shown in FIG. 12. When the articles packaged in the carton are those cans having recessed bottoms, the arched, or upwardly convexly curved, upper edge of the stopper wall 185 is useful to snugly fit in the recessed bottom of the endmost can. A preferred radius of curvature of the arched upper edge may be generally equal to the radius of curvature of the inside surface of the recessed bottom. Such an arrangement enhances the stability of the article on the stopper wall 185.

The present invention and its preferred embodiments relate to an arrangement for providing an article dispenser or access opening in a fully enclosed carton. The invention serves as a useful dispensing carton that can be placed upon a surface or within a compartment such as a refrigerator or pantry. However, it is anticipated that the invention can be applied to a variety of cartons and is not limited to those cartons for cans or bottles.

It will be recognised that as used herein, directional references such as "top", "base", "bottom", "end", "side", "inner", "outer", "upper", "middle", "lower", "front" and "rear" do not limit the respective panels to such orientation, but merely serve to distinguish these panels from one another. Any reference to hinged connection should not be construed as necessarily referring to a single fold line only: indeed it is envisaged that hinged connection can be formed from one or more of one of the following, a score line, a frangible line or a fold line, without departing from the scope of invention.

It should be understood that various changes may be made within the scope of the present invention, for example, the size and shape of the panels and apertures may be adjusted to accommodate articles of differing size or shape, alternative end wall structures may be used. The carton may accommodate more than one article in different arrays. Although the upper edge 81 of the stopper wall 80 in FIGS. 6 and 7 is shown as horizontally extending, the upper edge 81 may be arched in the manner similar to that of the stopper wall 185 in FIGS. 11 and 12. The highest point along such an arched upper edge in a carton with a three-tier group of cylindrical articles may be greater than three halves of the diameter of each article, or than a half of the height of the carton, and preferably less than twice the diameter of each article. On top of such a stopper wall, the endmost article once removed from the uppermost tier may be placed with its bottom down in a similar fashion to FIG. 12.

What is claimed is:

1. A carton, comprising:

a top wall, a pair of opposed side walls connected to opposed side edges of the top wall, an end wall interconnecting the side walls, a bottom wall interconnecting respective lower edges of the side walls; and an article-dispenser including a removable corner portion defined by severance lines formed respectively in the top wall, the side walls and the end wall;

wherein the severance line in each of the side walls comprises a concave section for defining a recess in said each side wall upon removal of the corner portion;

wherein each of the side wall severance lines substantially continuously curves downwardly from the top wall to a lowest point along said concave section thereof and extends upwardly from the lowest point to the end wall to be continuous with the severance line in the end wall; and wherein said each side wall severance line extends to a connection of a respective one of the side walls with the end wall at a distance above the bottom wall generally equal to a half of the height of the carton, and said lowest point of said each side wall severance line is spaced at a distance above the bottom wall less than a half of the height of the carton.

2. The carton as claimed in claim 1, wherein the concave section of each of the side wall severance lines is essentially U-shaped.

3. The carton as claimed in claim 1, wherein the end wall severance line extends continuously between the side walls so that an article stopper wall is formed from the end wall upon removal of the corner portion, the stopper wall extending continuously between the side walls.

4. The carton as claimed in claim 3, wherein the highest point along an upper edge of the stopper wall is spaced at a first distance above the bottom wall, said lowest point along the concave section of said each side wall severance line is spaced at a second distance above the bottom wall, the first distance is greater than the second distance.

5. A blank for forming the carton as claimed in claim 1.

6. A package, comprising:

an article group formed of at least two vertically arranged tiers of similarly dimensioned, cylindrical articles disposed on sides thereof in a side-by-side parallel fashion; and a carton disposed around said group, said carton comprising:

a plurality of walls including a top wall, a pair of opposed side walls connected to opposed side edges of said top wall, an end wall interconnecting said side walls, and a bottom wall interconnecting respective lower edges of said side walls; and an article dispenser for dispensing said articles from said carton, said dispenser including a removable corner portion of said carton formed from and detachably connected to said top, side and end walls along a detachable connection, to be removed from said carton thereby to define an opening for exposing at least some of said articles for removal;

wherein said opening is shaped to define a recess comprising a concave section in each of said side walls to reveal at least a part of an endmost article in a lowermost tier of said article group, each of said recesses extending to a connection of a respective one of said side walls with said end wall at a distance above the bottom wall generally equal to half of the height of the carton; and wherein said detachable connection comprises severance lines for defining an edge of said opening, said severance lines being formed respectively in said top wall, said side walls and said end wall, each of said side wall severance lines extending downwardly from said top wall to a lowest point along said concave section thereof and extending upwardly from said lowest point to said end wall to be continuous with said severance line in said end wall at a distance above said bottom wall generally equal to three halves the diameter of each of said articles, and said lowest point of said each side wall severance line is spaced at a distance above the bottom wall less than said diameter.

7. A package, comprising:

an article group formed of three vertically arranged tiers of similarly dimensioned, cylindrical articles disposed on sides thereof in a side-by-side parallel fashion; and a carton disposed around said group, said carton comprising:

a plurality of walls including a top wall, a pair of opposed side walls connected to opposed side edges of said top wall, an end wall interconnecting said side walls, a bottom wall interconnecting respective lower edges of said side walls; and an article dispenser for dispensing said articles from said carton, said dispenser including a removable corner portion of said carton formed from said top, side and end walls and detachably connected to said top, side and end walls along a detachable connection to be removed from said carton thereby to define an opening for exposing at least some of said articles for removal;

wherein said opening is shaped to define a recess in each of said side walls to reveal at least a part of an end most article in a lowermost tier of said article group; and wherein said detachable connection comprises severance lines for defining an edge of said opening, said severance lines being formed respectively in said top wall, said side walls and said end wall, and wherein said severance line in said each side wall comprises a concave section for defining said recess in said each side wall;

wherein each of said side wall severance lines extends downwardly from said top wall to a lowest point along said concave section thereof and extends upwardly from said lowest point to said end wall to be continuous with said severance line in said end wall at a distance above the bottom wall generally equal to half of the height of the carton; and wherein said side wall severance lines are disposed respectively across opposite ends of said endmost article in said lowermost tier.

8. A package, comprising:

an article group formed of at least two vertically arranged tiers of similarly dimensioned, cylindrical articles disposed on sides thereof in a side-by-side parallel fashion; and a carton disposed around said group, said carton comprising:

a plurality of walls including a top wall, a pair of opposed side walls connected to opposed side edges of said top wall, an end wall interconnecting said side walls, a bottom wall interconnecting respective lower edges of said side walls; and an article dispenser for dispensing said articles from said carton, said dispenser including a removable corner portion of said carton formed from said top, side and end walls and detachably connected to said top, side and end walls along a detachable connection to be removed from said carton thereby to define an opening for exposing at least some of said articles for removal, said opening is shaped to define a recess in each of said side walls to reveal at least a part of an endmost article in a lowermost tier of said article group;

wherein said detachable connection comprises severance lines for defining an edge of said opening, said severance lines being formed respectively in said top wall, said side walls and said end wall, and wherein said severance line in said each side wall comprises a substantially continuously curved concave section for defining said recess in said each side wall;

wherein said severance line in said end wall extends continuously between said side walls so that the article stopper wall is formed from said end wall upon removal of said corner portion, said stopper wall extending continuously between said side walls;

wherein the highest point along an upper edge of said stopper wall is spaced at a first distance above the bottom wall, the lowest point along said concave section of each of said side wall severance lines is spaced at a second distance above the bottom wall, said first distance is greater than the diameter of each of said articles, and said second distance is less than said diameter; and wherein said article group is formed of three vertically arranged tiers of said articles, and said side wall severance lines are disposed respectively across opposite ends of said endmost article in said lowermost tier.

9. A package, comprising:

an article group formed of at least two vertically arranged tiers of similarly dimensioned, cylindrical articles disposed on sides thereof in a side-by-side parallel fashion; and a carton disposed around said group, said carton comprising:

a plurality of walls including a top wall, a pair of opposed side walls connected to opposed side edges of said top wall, an end wall interconnecting said side walls, a bottom wall interconnecting respective lower edges of said side walls; and an article dispenser for dispensing said articles from said carton, said dispenser including a removable corner portion of said carton formed from said top, side and end walls and detachably connected to said top, side and end walls along a detachable connection to be removed from said carton thereby to define an opening for exposing at least some of said articles for removal, said opening is shaped to define a recess in each of said side walls to reveal at least a part of an endmost article in a lowermost tier of said article group;

wherein said detachable connection comprises severance lines for defining an edge of said opening, said severance lines being formed respectively in said top wall, said side walls and said end wall, and wherein said severance line in said each side wall comprises a substantially continuously curved concave section for defining said recess in said each side wall;

wherein said severance line in said end wall extends continuously between said side walls so that the article stopper wall is formed from said end wall upon removal of said corner portion, said stopper wall extending continuously between said side walls; and wherein the highest point along an upper edge of said stopper wall is spaced at a first distance above the bottom wall, the lowest point along said concave section of each of said side wall severance lines is spaced at a second distance above the bottom wall, said first distance is greater than the diameter of each of said articles, and said second distance is less than said diameter;

wherein each of said side wall severance lines extends downwardly from said top wall to a lowest point along said concave section thereof and extends upwardly from said lowest point to said end wall to be continuous with said severance line in said end wall; and wherein said each side wall severance line extends to a connection of a respective one of said side walls with said end wall at a distance above said bottom wall generally equal to three halves of the diameter of each of said articles, and said lowest point of said each side wall severance line is spaced at a distance above the bottom wall less than said diameter.

10. A package, comprising:

an article group formed of at least two vertically arranged tiers of similarly dimensioned, cylindrical articles disposed on sides thereof in a side-by-side parallel fashion; and a carton disposed around said group, said carton comprising:

a plurality of walls including a top wall, a pair of opposed side walls connected to opposed side edges of said top wall, an end wall interconnecting said side walls, a bottom wall interconnecting respective lower edges of said side walls; and an article dispenser for dispensing said articles from said carton, said dispenser including a removable corner portion of said carton formed from said top, side and end walls and detachably connected to said top, side and end walls along a detachable connection to be removed from said carton thereby to define an opening for exposing at least some of said articles for removal, said opening is shaped to define a recess in each of said side walls to reveal at least a part of an endmost article in a lowermost tier of said article group;

wherein said detachable connection comprises severance lines for defining an edge of said opening, said severance lines being formed respectively in said top wall, said side walls and said end wall, and wherein said severance line in said each side wall comprises a substantially continuously curved concave section for defining said recess in said each side wall;

wherein said severance line in said end wall extends continuously between said side walls so that the article stopper wall is formed from said end wall upon removal of said corner portion, said stopper wall extending continuously between said side walls; and wherein the highest point along an upper edge of said stopper wall is spaced at a first distance above the bottom wall, the lowest point along said concave section of each of said side wall severance lines is spaced at a second distance above the bottom wall, said first distance is greater than the diameter of each of said articles, and said second distance is less than said diameter;

wherein each of said side wall severance lines extends downwardly from said top wall to a lowest point along said concave section thereof and extends upwardly from said lowest point to said end wall to be continuous with said severance line in said end wall; and wherein said article group is formed of three vertically arranged tiers of said articles, and said side wall severance lines are disposed respectively across opposite ends of said endmost article in said lowermost tier.

* * * * *